US009468319B2

(12) United States Patent
Wagner

(10) Patent No.: US 9,468,319 B2
(45) Date of Patent: Oct. 18, 2016

(54) PILLOW STRUCTURE

(71) Applicant: John Jay Wagner, New Canaan, CT (US)

(72) Inventor: John Jay Wagner, New Canaan, CT (US)

(73) Assignee: PILLOWVISION, LLC., San Marino, CA (US)

( * ) Notice: Subject to any disclaimer, the term of this patent is extended or adjusted under 35 U.S.C. 154(b) by 0 days.

(21) Appl. No.: 14/819,641

(22) Filed: Aug. 6, 2015

(65) Prior Publication Data

US 2015/0335180 A1 Nov. 26, 2015

Related U.S. Application Data

(62) Division of application No. 13/902,741, filed on May 24, 2013, now Pat. No. 9,131,792.

(51) Int. Cl.

*A47G 9/10* (2006.01)
*A47C 20/02* (2006.01)
*A47C 16/00* (2006.01)

(52) U.S. Cl.

CPC ..... *A47G 9/1063* (2013.01); *A47C 16/00* (2013.01); *A47C 20/026* (2013.01); *A47G 2009/1018* (2013.01)

(58) Field of Classification Search

CPC A47C 20/027; A47C 27/146; A47C 20/026; A47C 9/1063; A47C 16/00; A47G 9/10; A47G 9/1063; A47G 2009/1018; A47G 9/1054; A47G 9/062

See application file for complete search history.

(56) References Cited

U.S. PATENT DOCUMENTS 2,107,962 A * 2/1938 Sheasby ..... A47C 20/026 5/189
2,551,727 A * 5/1951 Costello ..... A47C 16/00 5/638
2,688,142 A * 9/1954 Jensen ..... A47G 9/1009 5/638
3,009,172 A 9/1961 Eidam
3,366,106 A * 1/1968 Yao ..... A45D 44/22 493/269
3,883,906 A 5/1975 Sumpter
3,897,102 A * 7/1975 Lemaire ..... A47C 1/143 297/283.3
D271,834 S * 12/1983 Huntsinger ..... 5/637
D277,059 S 1/1985 Boone
4,821,355 A * 4/1989 Burkhardt ..... A47G 9/10 5/636
D309,542 S 7/1990 Glenn (Continued)

*Primary Examiner* — David E Sosnowski
*Assistant Examiner* — Eric Kurilla
(74) *Attorney, Agent, or Firm* — Gordon Rees Scully Mansukhani LLP; Kathryn K. Hull; David R. Heckadon

(57) ABSTRACT

A supporting pillow structure for a user to sleep or to perform sedentary activity facing down toward the pillow structure with the user's hands and arms placed underneath their face. The pillow structure includes a top opening substantially on the top surface of the pillow structure for the user's face to lean into the pillow structure, at least two side openings in the side of the pillow structure for the user to insert the user's arms into the pillow structure and place the user's arms underneath their head or body comfortably and to increase airflow for the user to breathe comfortably while resting, and a cavity in the middle of the pillow structure for airflow between the openings and for placing objects within the pillow structure, allowing the user to perform tasks requiring minimal physical activity while remaining comfortable and sedentary for an extended period of time. Embodiments of the pillow structure may be configured to provide users with comfort and support while the user is seated leaning forward on an airplane or at a desk or table or while the user is lying facing down on a substantially level surface such as a bed.

14 Claims, 18 Drawing Sheets

(56) References Cited

U.S. PATENT DOCUMENTS

D337,914 S 8/1993 McDonald
5,269,035 A * 12/1993 Hartunian ..... A47C 20/026 5/637
5,369,824 A 12/1994 Powell
5,400,449 A 3/1995 Satto
D364,464 S 11/1995 Gigante
5,479,667 A 1/1996 Nelson
5,632,050 A * 5/1997 Zajas ..... A47C 20/026 5/632
5,644,809 A * 7/1997 Olson ..... A47G 9/10 5/636
5,652,981 A * 8/1997 Singer-Leyton ..... A47C 20/026 5/631
5,865,181 A * 2/1999 Spence, Jr. ..... A61G 13/12 128/845
5,893,183 A * 4/1999 Bechtold, Jr. ..... A47C 20/021 128/845
D414,974 S * 10/1999 Marrone, II ..... 5/638
5,960,494 A * 10/1999 Gilliland ..... A61G 13/12 5/638
6,128,797 A * 10/2000 Shaffer ..... A47C 16/00 5/638
6,142,844 A * 11/2000 Klauber ..... B63C 11/49 441/129
6,151,734 A * 11/2000 Lawrie ..... A47C 20/026 5/622
D471,050 S 3/2003 Haubner
6,671,907 B1 * 1/2004 Zuberi ..... A47G 9/1063 128/845
6,842,924 B1 * 1/2005 Walters ..... A47C 20/026 5/636
7,020,918 B1 * 4/2006 Tinsley ..... A47C 16/00 5/630
D578,220 S 10/2008 Ebarb
D585,139 S 1/2009 Andrews
7,788,751 B1 * 9/2010 Diemer ..... A47C 16/00 297/391
7,997,276 B2 * 8/2011 Goff ..... A61F 5/56 128/845
8,006,335 B1 * 8/2011 Andermann ..... A61G 7/07 5/632
8,069,515 B1 * 12/2011 Tingey ..... A47C 20/023 5/632
D686,026 S 7/2013 Wagner
8,549,683 B2 * 10/2013 Ratner ..... A61G 13/121 128/845
D715,580 S * 10/2014 Ganjavian ..... D6/601
D718,074 S * 11/2014 Savolainen ..... D6/601
2002/0177946 A1 11/2002 Ueno
2002/0184706 A1 * 12/2002 Riach ..... A61B 6/0421 5/632
2003/0172462 A1 * 9/2003 Hoggatt ..... A47C 20/026 5/657
2004/0064893 A1 * 4/2004 Sharp ..... A47C 7/383 5/655.3
2008/0303318 A1 * 12/2008 Hamilton ..... A47C 16/00 297/129
2009/0302659 A1 * 12/2009 Goddu ..... A47C 7/383 297/391
2010/0242179 A1 9/2010 Berke
2010/0300455 A1 12/2010 Goff
2011/0296615 A1 * 12/2011 Tingey ..... A47G 9/10 5/632
2013/0276236 A1 * 10/2013 Rasmussen ..... A47G 9/1027 5/640

* cited by examiner

PILLOW STRUCTURE

CROSS REFERENCE TO RELATED APPLICATIONS

This application is a divisional of U.S. application Ser. No. 13/902,741 filed on May 24, 2013, the contents of which are incorporated by reference in their entirety herein.

FIELD OF THE INVENTION

This invention relates in general to pillows and more specifically to a pillow structure having a cavity in the pillow structure and openings from the outside of the structure to the cavity so that users can rest face-down on the structure and place their hands and arms into the structure and be able to view an item placed into a cavity in the middle of the pillow structure through the opening for their face.

BACKGROUND OF THE INVENTION

There are many bedding products, including mattresses and pillows designed to increase a user's comfort while lying down to sleep or rest or perform sedentary activities. Some major concerns for people lying down or sleeping are related to breathing, pressure, stress, alignment, and overall comfort. These concerns can be greater for overweight or taller users, athletic users, and pregnant women.

Most pillows are designed to provide support for the user's head and neck while the user lays down on their back or side. Some designs are created to keep the user's spine in alignment while the user sleeps on their side or back. These pillows may be designed with curves upward to provide further support in the area at the base of the skull for the user sleeping on their back or at the neck and jawline of the user sleeping on their side. Some pillows are manufactured out of special materials to provide support or flexibility and to contour to the user's unique shape. However, not all people prefer to lay down or sleep on their back or side, and the above mentioned specially designed pillows are not comfortable for a user who chooses to sleep on their front facing the pillow.

Some people prefer to sleep or rest face-down to increase their comfort and alleviate their concern with breathing, loss of circulation, and pressure. For example, some people sleep face down because they are uncomfortable sleeping on their back due to breathing problems, such as a closing of their airway or sleep apnea. Some people sleep face down because they find that sleeping on their side will cause their arms to fall asleep or their spine to feel misaligned. Many people toss and turn throughout the night trying to get comfortable or reposition their body to relieve some stress on their arms, hips, neck, head, and back.

Sleeping face-down on a standard pillow can cause issues with airflow, breathing, and temperature control. Sleeping facing down can also cause problems with blood circulation in the arms if the arms are pressed under the body. It can also cause breathing problems or issues with air flow or circulation when the user is facing the pillow. Further, issues with temperature control can be caused by breathing into a pillow pressed against the user's face. Some users turn their head sideways when sleeping face-down to increase airflow and temperature control. This can cause a strain on the user's neck, arms, and back if the user turns their head to sleep with their current pillows. Pillows have been designed to help provide a place for an adult's face to lay, or a hole, which allows room for the user to breathe, for example U.S. Design Pat. No. D277,059 (Boone).

Some users take stress off their neck when they sleep on their front by placing their arms or hands under the pillow to prop the pillow up to. This can cause a loss of blood circulation to the arms or hands with their arm placed under the pressure of the body, head, or pillow. One attempt to solve this problem of creating space under a pillow, is U.S. Pat. No. 3,883,906 (Sumpter), which provides tunnel-like openings for the arms of a sleeper. Sumpter provides that the user's arms would be extended above the user's head and parallel to their body underneath the pillow. The problems described above also occur when the user tries to perform sedentary tasks when resting on their front facing a pillow structure. For example, users seek a comfortable way to perform sedentary tasks, such as reading email or typing on an electronic device, reading books, or performing tasks on their mobile devices, cell phones, or tablets while resting. These tasks can include many different tasks on various devices or objects, such as reading and writing emails and text messages; watching videos, such as sports, movies and television shows; surfing the internet; reading the news and gossip; shopping online; and other tasks requiring limited ability to move. With the proliferation of smaller devices capable of performing these tasks and other tasks, people are more likely to perform these tasks on a smaller device and at various locations. Although these tasks may take place while the user is seated, such as on an airplane, or at a desk, or at a table, these tasks may alternately take place while the user is leaning forward while seated or while the user is lying down. Many people perform these tasks in bed. Some people are not comfortable lying on their back while holding a book or mobile device, cell phone, or tablet above them for an extended period of time. Holding an object above your face for an extended period of time can be uncomfortable. Some people are not comfortable lying on their side for an extended period of time holding a book or device. Lying on one's side limits the ability of one arm or hand to hold the book and turn the page or to touch the device. Further, many new devices contain technology that automatically turns the image on the device based on how the device is oriented, assuming the user is not lying sideways, so that a user reading a website or looking at a picture or video with their head turned sideways must awkwardly turn (or change the settings on their device).

Another problem people have is trying to rest or perform sedentary activities comfortably while seated. This is particularly the case while users are seated on an airplane or at a desk or table. Some pillows have been designed to help support the user's head and neck, but these do not provide the desired amount of support or stability. Some users lean forward and cross their arms and rest their head against their arms, turning their head to the side. This position allows for some level of comfort if the user can comfortably do so while bending at the waist. In many locations, bending at the waist is not a comfortable option, including on an airplane. Also, by turning their head, the user's spine is not aligned. Some users lean their head to the side or try to keep their head back against a headrest, but during their rest their head may lean forward or to a different side if not given the desired support. Leaning the head to the side for too long will also cause pain, stiffness, or soreness for the user's neck. By turning their head, the user's spine is not aligned and the user cannot comfortably rest or sleep. Based on the restricted size of seats, leg space, and lap space for user's sitting on airplanes, users seek a comfortable alternative to the available options. Users are particularly sedentary on airplanes, but the inventive pillow structure would be similarly useful for users seated at a desk or table.

Another problem people have while lying down is comfortably listening to audio through headphones. Some people listen to music, books "on tape," audio with video, or other sounds such as "white noise" while resting. People place headphones over their ears or place earbuds into their ears while leaning forward in a seated position or while lying down. Many headphones that cover the user's ears or earbuds inserted into the ear are not comfortable when the user's head is against a pillow or against the user's arm or another object. Pressure from an object against the headphones or earbuds, even from a relatively soft object such as a pillow, can cause discomfort to the user.

Designing a comfortable pillow structure that allows the user to rest facing down towards a pillow structure, while the user's arms and/or hands are comfortably placed underneath the user's head at an angle substantially perpendicular to the user's body would be a useful invention as it would allow the user to rest comfortably and position their arms in a manner that allowed flexibility in the user's movements and allow the user to perform sedentary activities. Designing a pillow structure with a cavity in the middle of the pillow structure for the user to place an object such as a book or device, and providing at least one opening for the user's face and at least two openings for the user's arms and/or hands that meet at the cavity would be a useful invention allowing the user to perform sedentary activities while comfortably resting. Designing a pillow structure with space in at least one opening to the cavity for wires, power cords, or headphones or earbuds would be a useful invention. Designing a pillow structure with a source of light for viewing objects placed in the cavity in the middle of the pillow structure the would be a useful invention.

SUMMARY OF THE INVENTION

The invention features a pillow structure for the user to rest facing down toward the pillow structure. The pillow structure has a top surface, at least two sides, a bottom, and a cavity in the middle of the pillow structure. The inventive pillow structure has a cavity in the middle of the structure, at least one opening located substantially on the top of the pillow structure for the user's face, at least two side openings in the sides of the pillow structure for the user's hands and arms to be placed within the cavity. The inventive pillow's cavity can be accessed from the outside of the pillow from the at least one opening on the top surface and from the at least two openings on the sides. The cavity may also be accessed from other openings of the pillow structure. All these openings may increase air flow and may provide a space for a light source and power source. Any opening may be large enough for the insertion of useful objects or devices into the pillow structure, such as wires, cords, and headphones to extend through the openings into the cavity.

DETAILED DESCRIPTION

Figure 1:
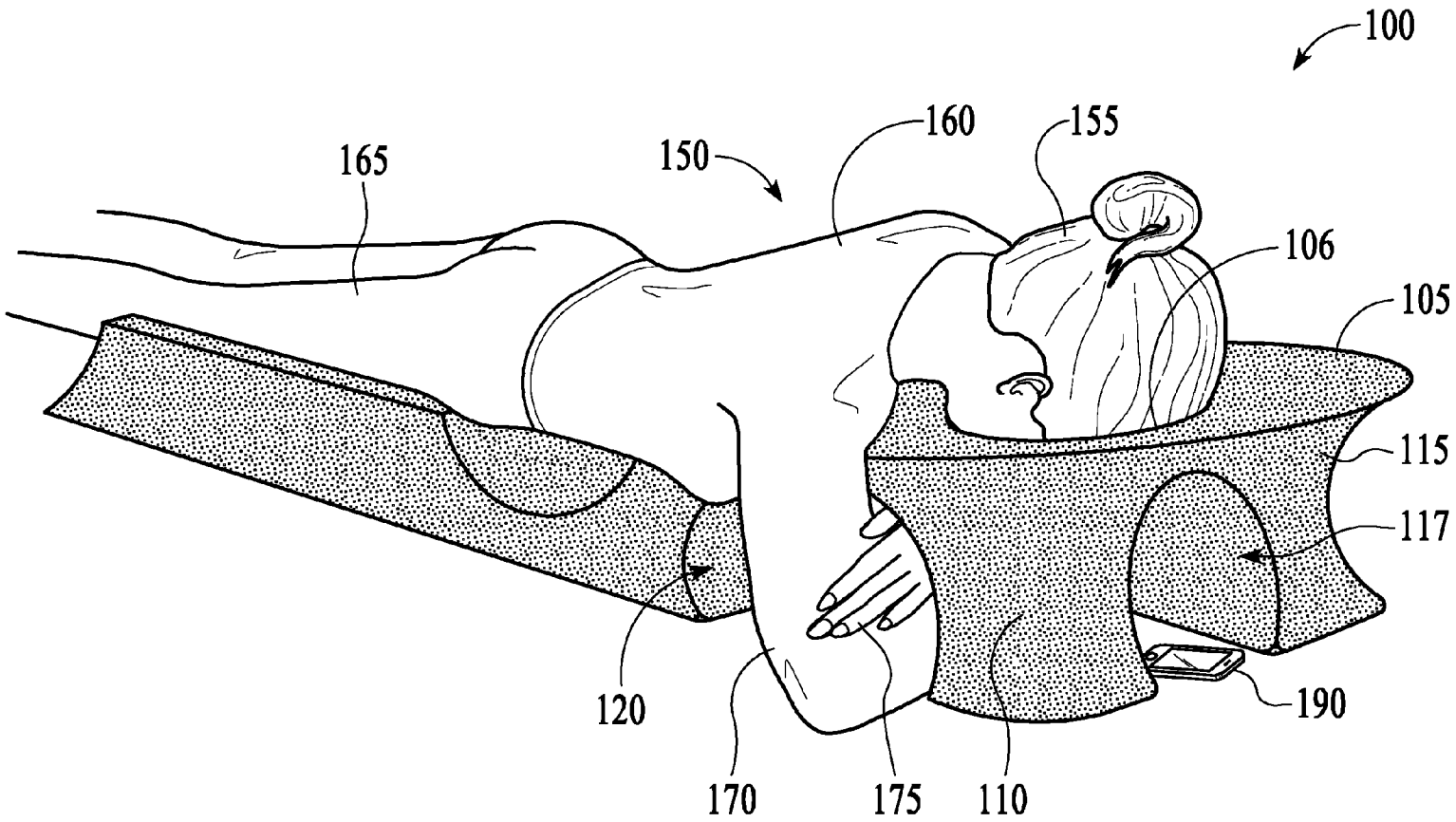
FIG. 1 is a top perspective view of a first embodiment of the inventive pillow structure, showing the embodiment in use in a first configuration.

A first embodiment of the inventive pillow structure 100 is shown in FIG. 1. FIG. 1 is a top perspective view of a first embodiment of the inventive pillow structure 100, showing the embodiment in use by a user 150. The pillow structure 100 in this first embodiment has a top surface 105, and at least two sides 110, and has a one side towards the user's head, referred to herein as the head-side 115 In the first embodiment, the user 150 is resting on the top surface of the pillow structure 105. In this embodiment, substantially all of the user's body 160 is resting on the top surface 105 of the pillow structure 100, except for the user's arms 170 and the user's legs 165 which comfortably extend beyond the pillow structure 100. In other embodiments, the pillow structure may be smaller and not designed to support substantially all of the user's entire body. For example, a different embodiment may be designed to support only the user's face 155 or a smaller portion of the user's body 160.

The top surface of the pillow structure 105 contains at least one opening 106 in the top surface. The user 155 can place her face into the opening in the top surface 106. There are at least two sides 110 to the pillow structure 100. There are at least two openings 120 in the at least two sides 110. The at least two openings in the sides 120 provide access to a cavity in the middle of the pillow structure 100. (The cavity will be described in the description of FIG. 2.) The user 150 can place their arms 170 and hands 175 into the openings in the sides 120 and reach into the cavity and through the pillow structure 100 to a different opening in the sides 120 or an opening in the head-side 117. The user 150 can also place one or more objects into the cavity, which could be a book or a device 190. The device 190 is herein defined as any type of device, such as an electronic device, a cellular phone, a mobile device, a gaming device, or a watch, that may contain audio or visual capabilities, or both, or may allow the user to communicate with others. The device 190 has a minimum size of a standard woman's size watch face or an Apple iPod shuffle product, which measures approximately 1 inch in height, 1 inch in width, and one-third of an inch in depth, including its clip; however, devices, particularly electronic devices and audio/visual devices, have been getting smaller, so the absolute minimum size of the openings in the sides 120, the opening in the top surface 106, and the cavity each depends on the size of the devices and the size of the user.

The perpendicular angle of the user's arms 170 when placed in the openings in the sides 120 provides additional comfort and the ability to view objects or devices 190 in the user's hands 175 when the user's hands 175 are directly below the user's face 155. By designing the pillow structure with side openings 120 that provide access to the cavity in the middle of the pillow structure, the user can lean their body 160 into the pillow structure and place their arms 170 horizontally underneath their head in a position substantially perpendicular to their body 160 position without the stress of the user's body-weight against their arms. The side openings 120 provide an inventive way for the user to place the user's arms 170 underneath their face 155 and support their weight with other parts of their body 160 against the top surface 105 of the pillow structure.

The user can place their arms 170 into the openings in the sides 120, and place their arms 170 underneath their face 155. In this embodiment, the user's arms 170 are substantially perpendicular to their body 160, providing a comfortable way to rest without pressure on the user's arms 170 caused by the weight of the user's body 160. The openings in the side 120 may be structurally supported by other materials such as plastic, foam, metal, or wood, providing additional support for the weight of the user's face 155 and body 160 on top surface of the pillow structure. Said side openings 120 can be any shape or size, so long as the material making up the pillow structure can allow the side openings to be sized that large. The pillow structure 100 may be filled with plastic, foam, feathers, air, or any material strong enough to support the weight from the user's face 155 and the front of the user's body 160 leaning against the top surface 105 of the pillow structure while still maintaining the cavity in the middle of the pillow structure and at least two side openings 120. Said side openings 120 can be circular shaped to the contours of the user's arm 170. Said side openings 120 may be open at the bottom, as demonstrated by the first embodiment as shown in FIG. 1, or may be closed.

The head-side of the pillow structure 115 in the first embodiment has at least one opening 117, which provides access to the cavity. This opening in the head-side 117 provides additional air flow and circulation from outside the pillow structure 100. This opening in the head-side 117 can be used to insert other objects, such as a book or device 190. This opening in the head-side 117 can be used for other reasons that provide additional utility to the pillow structure 100, including providing a space for illumination for a user reading a book, a power source for a user using a device, a space for wires or cords, such as wires for a headsets or earbuds. The opening in the head-side 117 can be used for a user to place their hand 175 or arm 170 out of the pillow structure 100.

The overall shape of the pillow structure 100 in the first embodiment is angled at a gradual incline so that the user's face 155 is at a slightly higher elevation than the user's body 160 and legs 165. The gradual incline allows for the user's body 160 to be supported throughout the pillow structure 100. This gradual incline allows for room for the cavity in the pillow structure beneath the user's face 155. This also allows for room for the user's arms 170 and hands 175 to fit under the user's face 155.

Figure 2:
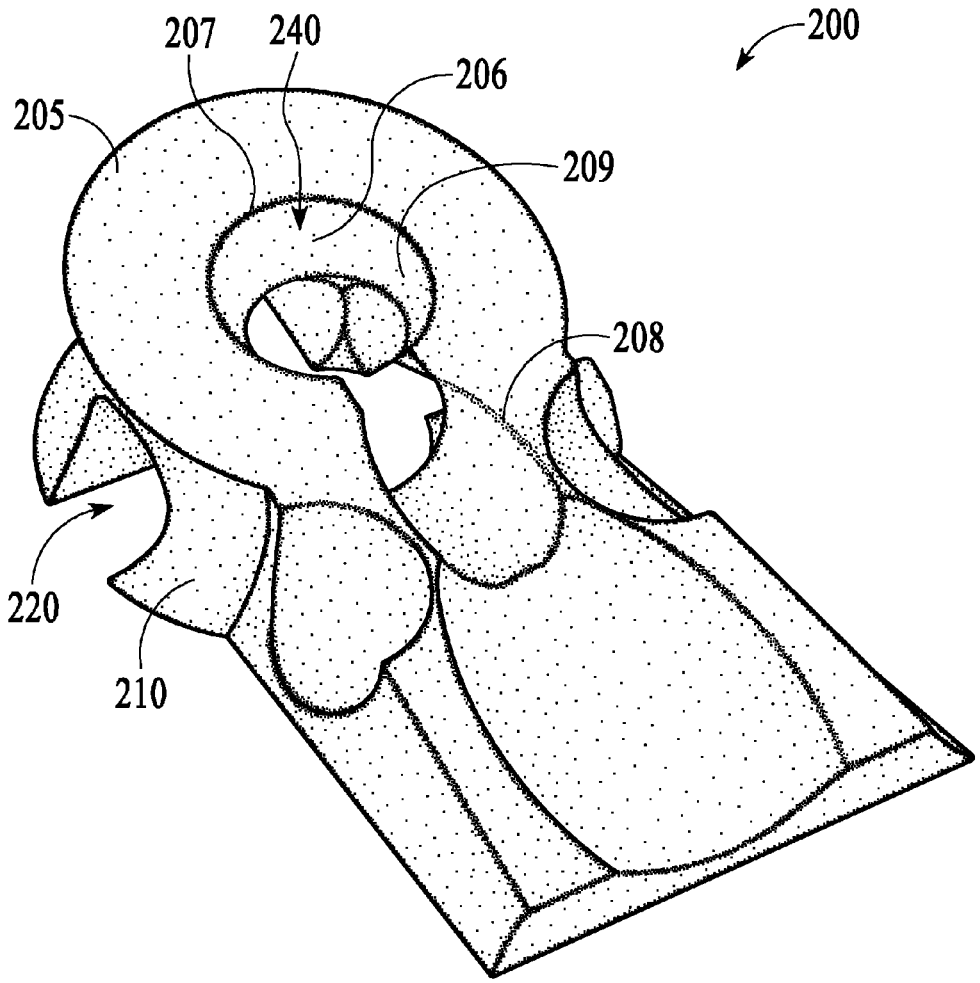
FIG. 2 is a top perspective view of the embodiment of FIG. 1, showing the pillow structure without a user.

FIG. 2 is a top perspective view of the embodiment of FIG. 1, showing the embodiment without a user. FIG. 2 illustrates the overall shape of the pillow structure 200 and shows the top surface 205 of the pillow structure, an opening 206 in the top surface. The at least one opening in the top surface 206 has a rim 207 around the opening. The user places her face into the opening in the top surface 206 and the user's face is supported by the rim 207 and inside edge 209. The rim 207 may be in a circular shape to comfortably fit the contours of the user's face. The rim 207 may be angled or rounded to provide more comfort for the user's face. The inside edge 209 can be curved or angled to provide further support to the user's face when the user's face is placed inside the opening 206. The rim 207 and inside edge 209 may have a removable cover or sheet to keep the pillow structure clean. The at least one opening in the top surface 206 provides access to a cavity 240. The cavity 240 can be accessed from the outside of the pillow from the at least one opening on the top surface 206 and from the at least two openings on the sides 220.

The opening in the top surface 206 is not circular in this embodiment, but instead has a figure-eight shape with a substantially circular-shaped rim 207 for the user's face 155 and a substantially oval-shaped rim 208 extended downward from the circular-shaped rim 207. The substantially oval-shaped rim 208 provides more air flow and circulation for a user's face 155 when the user is facing down into the opening at the top surface 206 and breathing into the cavity 240. The substantially oval-shaped rim 208 provides room for a user to insert one arm 170 into the opening at the top surface 206 if the user turns sideways. The sides 210 of the pillow structure are sloped in this embodiment in a concave shape. The sides 210 can be rounded, straight, concave, convex, or any other shape or combination of shapes. In another embodiment, the sides 210 may be straight down from the top surface 205 down to the base.

Figure 3:
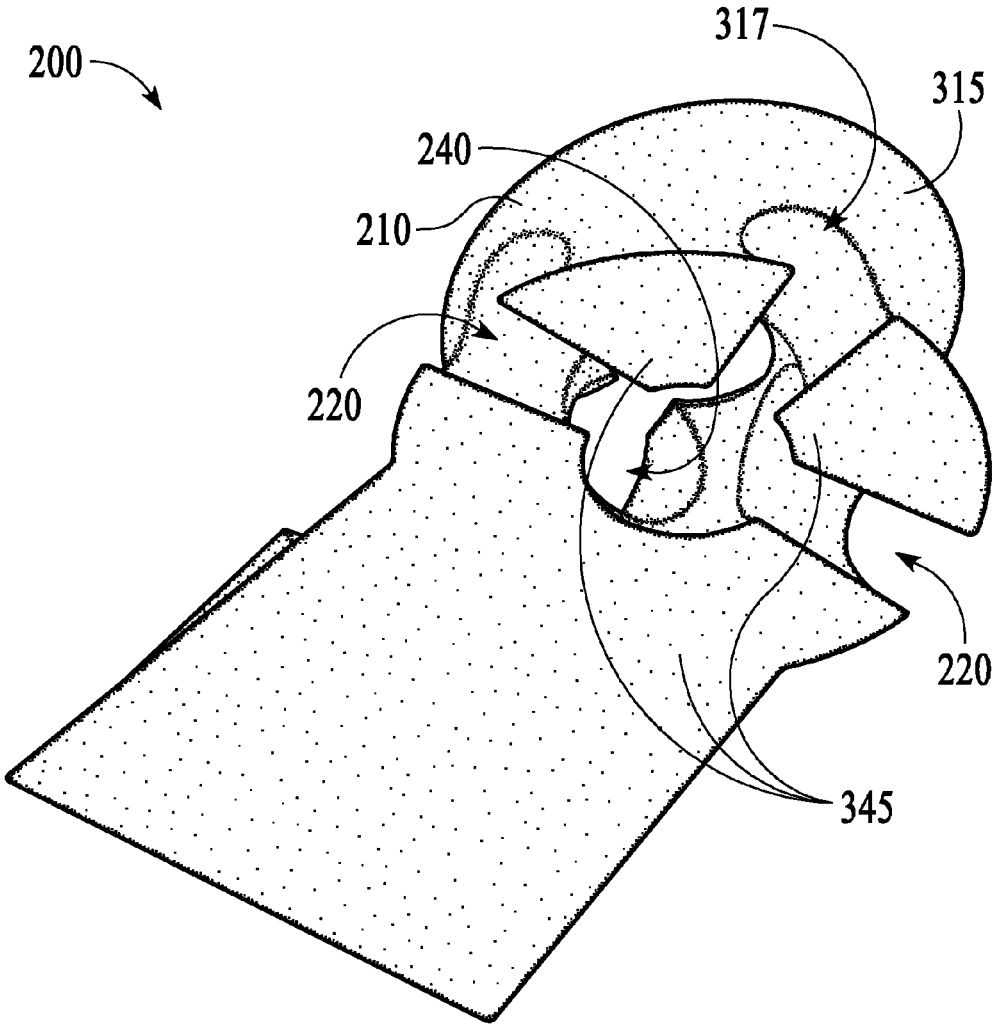
FIG. 3 is a bottom perspective view of the embodiment of FIG. 2.

FIG. 3 is a bottom perspective view of the embodiment of FIG. 2. The pillow structure 200 in this embodiment is supported with a flat base 345 at the bottom of the pillow structure. The flat base 345 may be various shapes, including circular, oval, square, rectangular, or any other shape. The flat base 345 is flat so that the pillow structure 200 can be placed onto a level surface. The flat base 345 may be flexible and able to accommodate to an uneven or un-level surface, such as a soft mattress on a bed. The base 345 in this embodiment is extended out from the sides 210 in order to provide a wider base and more support. With this wider base 345, the pillow structure is less likely to shift or tip over. The head-side 315 of the pillow structure contains at least one opening 317. The cavity 240 can be accessed from the outside of the pillow from the at least two openings on the sides 220 and the at least one opening in the head-side 317. The at least two openings in the sides 220 and the at least one opening in the head-side 317 are not circular in this embodiment, shown by the cut-outs in the shape of the base 345. The cavity 240 has more space for air flow and circulation with the openings in the sides 320 and opening in the head-side 317 cut through the base 345. This space can also provide more illumination from outside the pillow structure 200 and space for objects such as a device to be placed into the cavity 240, including wires and cords.

Figure 4:
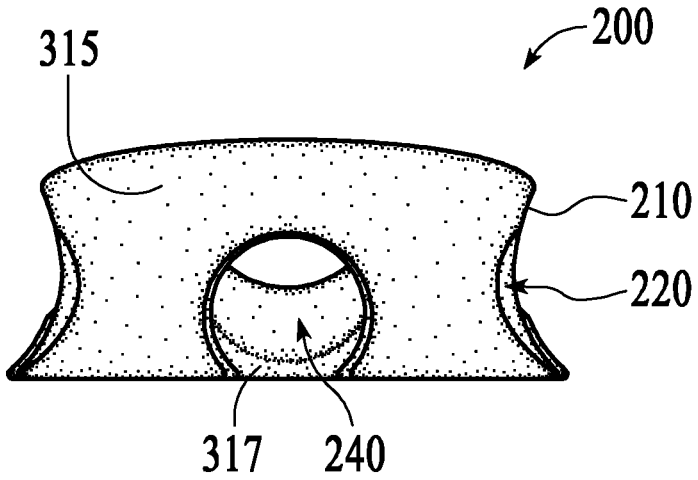
FIG. 4 is a head-side view of the embodiment of FIG. 2.

FIG. 4 is head-side view of the embodiment of FIG. 2. This view shows the head-side 315 of the pillow structure, the at least one opening 317 in the head-side of the pillow structure, and the cavity 240. This angle illustrates the concave curved shapes of the sides of the pillow structure 210 and the head-side of the pillow structure 315 and the wider base 345. From this angle, FIG. 2 demonstrates the air flow from the at least two openings in the sides 220 and the at least one opening in the head-side 317 through the cavity 240 to the opening at the top surface.

Figure 5:
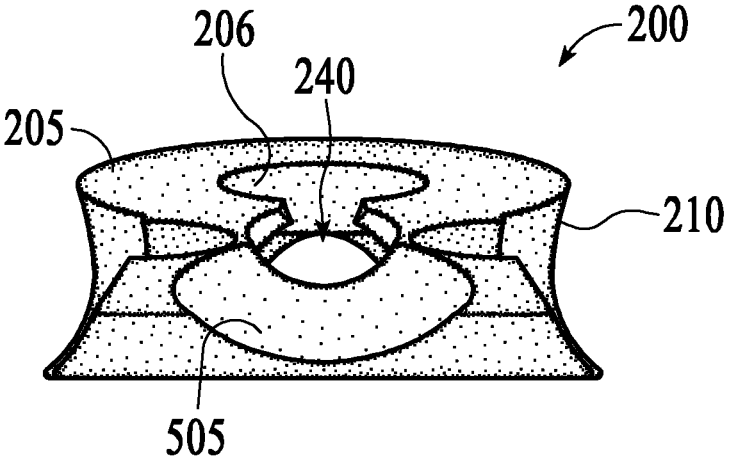
FIG. 5 is a front view of the embodiment of FIG. 2.

FIG. 5 is front view of the embodiment of FIG. 2. This view shows the incline of the top surface 205 of the pillow structure, and the contours 505 in the top surface of the pillow that are concave to form to the shape of the user 150. These contours in the top surface 505 can be deeper or wider to accommodate a larger user 150, such as a pregnant woman. The contours 505 could be various shapes for different parts of a user's body 160, such as the user's stomach, chest, shoulders, hips, legs, knees, or other body parts.

Figure 6:
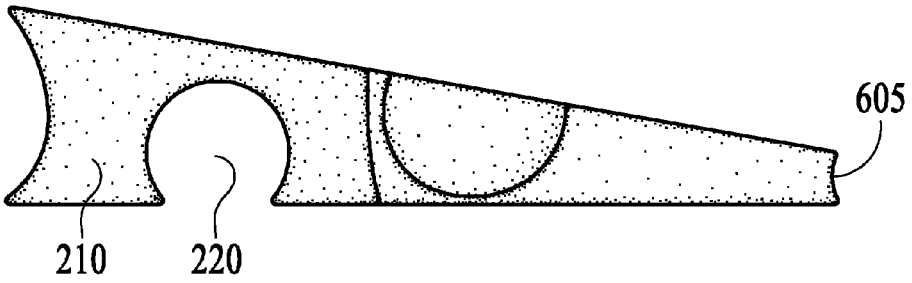
FIG. 6 is a right side view of the embodiment of FIG. 2.

FIG. 6 is right side view of the embodiment of FIG. 2. This view demonstrates that the side openings 320 are on substantially opposite sides of the pillow structure 200, as the angle shows that objects can pass straight through one side opening 320 through the cavity 240 and through the other side opening 320. This view shows the gradual incline of the pillow structure 100. The bottom end 605 is the space where the top surface 205 meets the base 345. The bottom end 605 can be a minimal height if the top surface 205 makes contact with the base 345, making the pillow structure 200 substantially resemble a triangle-shape. The bottom end 605 can be various heights at various points, based on the contours in the top surface 205 and the flexible shape of the base 345, or it could be the same height throughout the bottom end 605 from one side 210 of the pillow structure to the other side 210.

Figure 7:
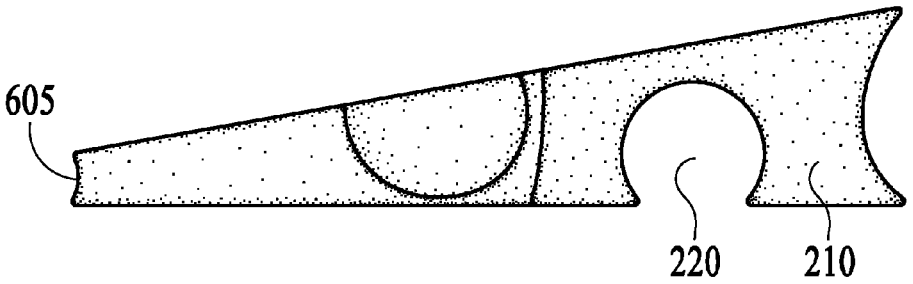
FIG. 7 is a left side view of the embodiment of FIG. 2.

FIG. 7 is left side view of the embodiment of FIG. 2. This view further demonstrates that the side openings 320 are on substantially opposite sides of the pillow structure 200. This view shows the gradual incline of the pillow structure 100 from the opposite view from FIG. 6.

Figure 8:
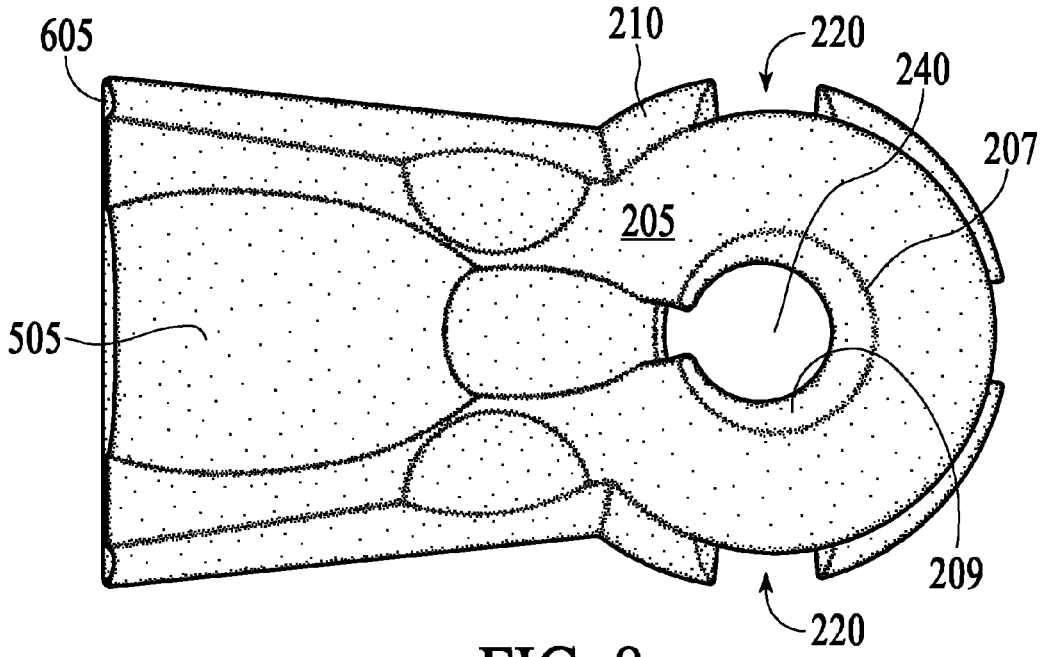
FIG. 8 is a top view of the embodiment of FIG. 2.

FIG. 8 is top view of the embodiment of FIG. 2. FIG. 8 further demonstrates that the base 345 of the pillow structure 200 is wider than the top surface 205 of the pillow structure in this embodiment. This angle also shows the inside edge 209 of the opening in the top surface 206. The inside edge 209 in this embodiment provides more support for the user's face when placed into the opening of the top surface 206. In this embodiment, the inside edge 209 of the top opening 206 is narrower than the circular-shaped rim 207 of the top opening 206. The inside edge 209 can be any shape, width, height, and diameter.

Figure 9:
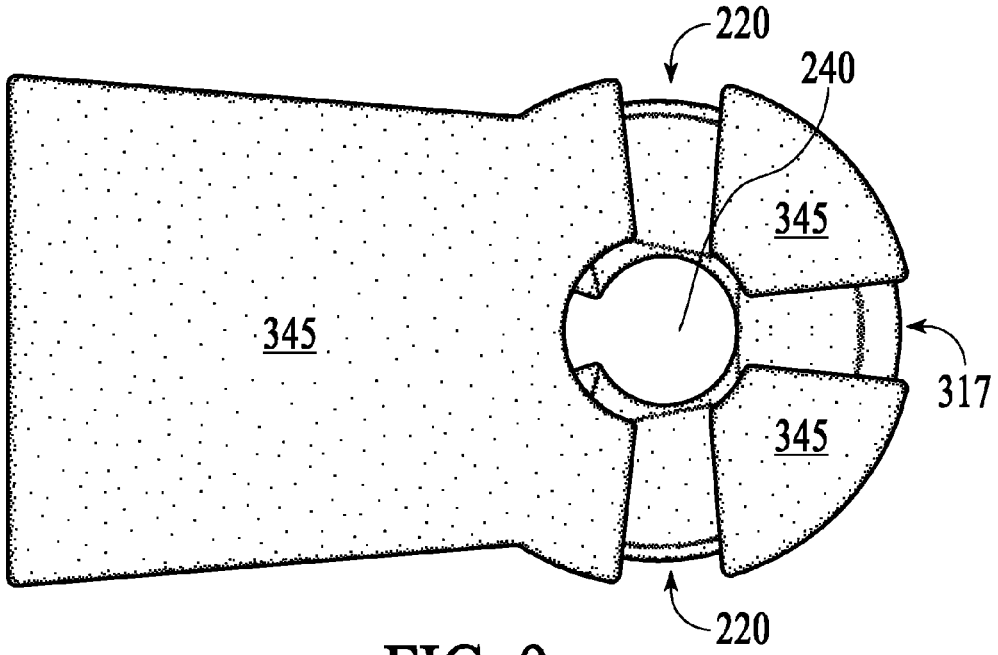
FIG. 9 is a bottom view of the embodiment of FIG. 2.

FIG. 9 is bottom view of the embodiment of FIG. 2. FIG. 9 further demonstrates the overall shape of the base 345 of the pillow structure 200.

Figure 10:
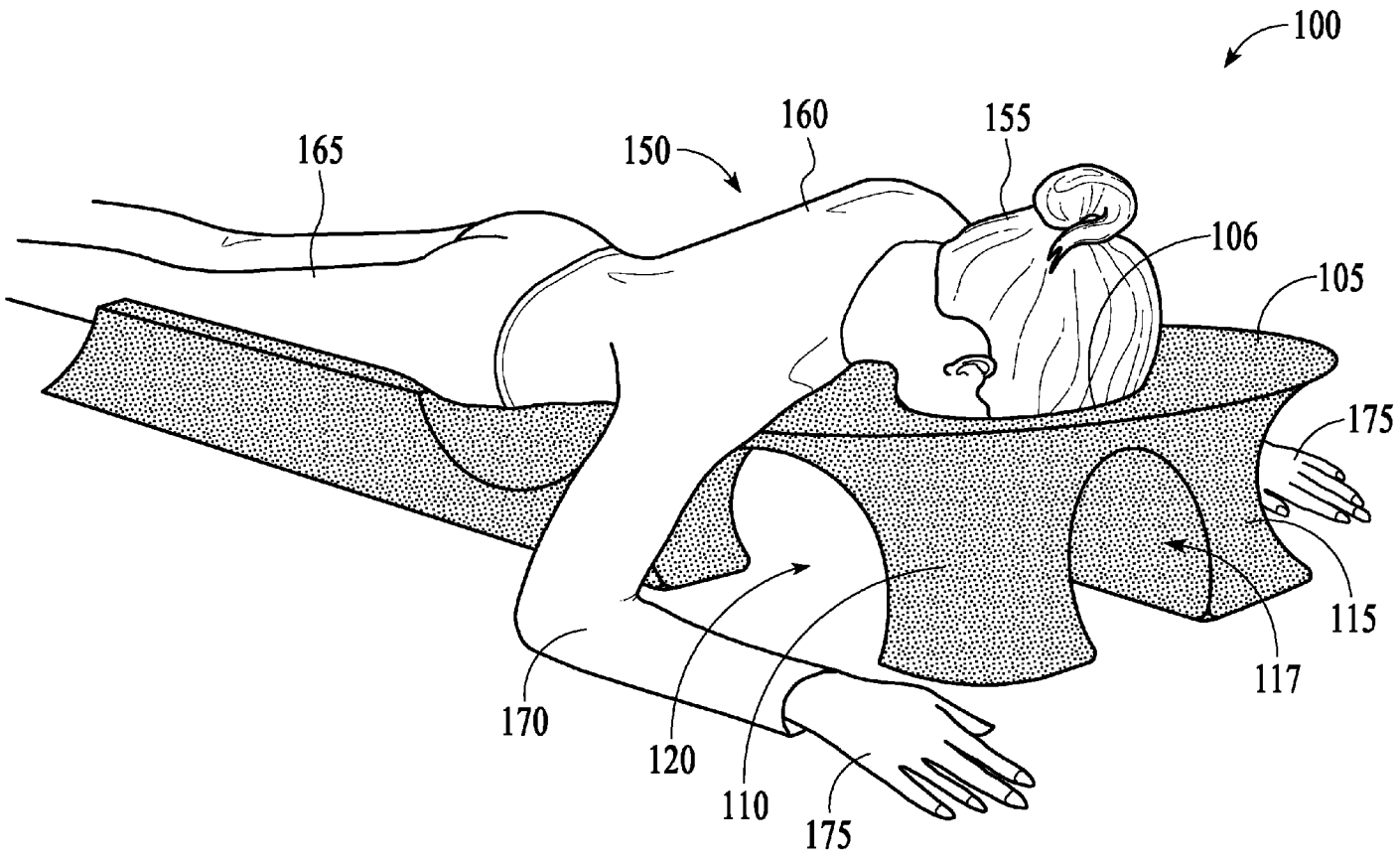
FIG. 10 is a second top perspective view of the embodiment of FIG. 1 showing the embodiment in use in a second configuration.

FIG. 10 is a second top perspective view of a first embodiment of the inventive pillow structure, showing the embodiment in use in a second configuration. FIG. 10 shows the first embodiment with the user's arms 170 and hands 175 lying to the side outside the pillow structure 100. The user's arms 170 and hands 175 could be placed inside the openings in the side 120. The user's face 155 is still facing the pillow structure 100 and placed inside the opening in the top 106. The pillow structure 100 is designed to be comfortable whether the user 155 places their arms 170 and hands 175 inside the at least two openings in the side 120 or does not.

Figure 11:
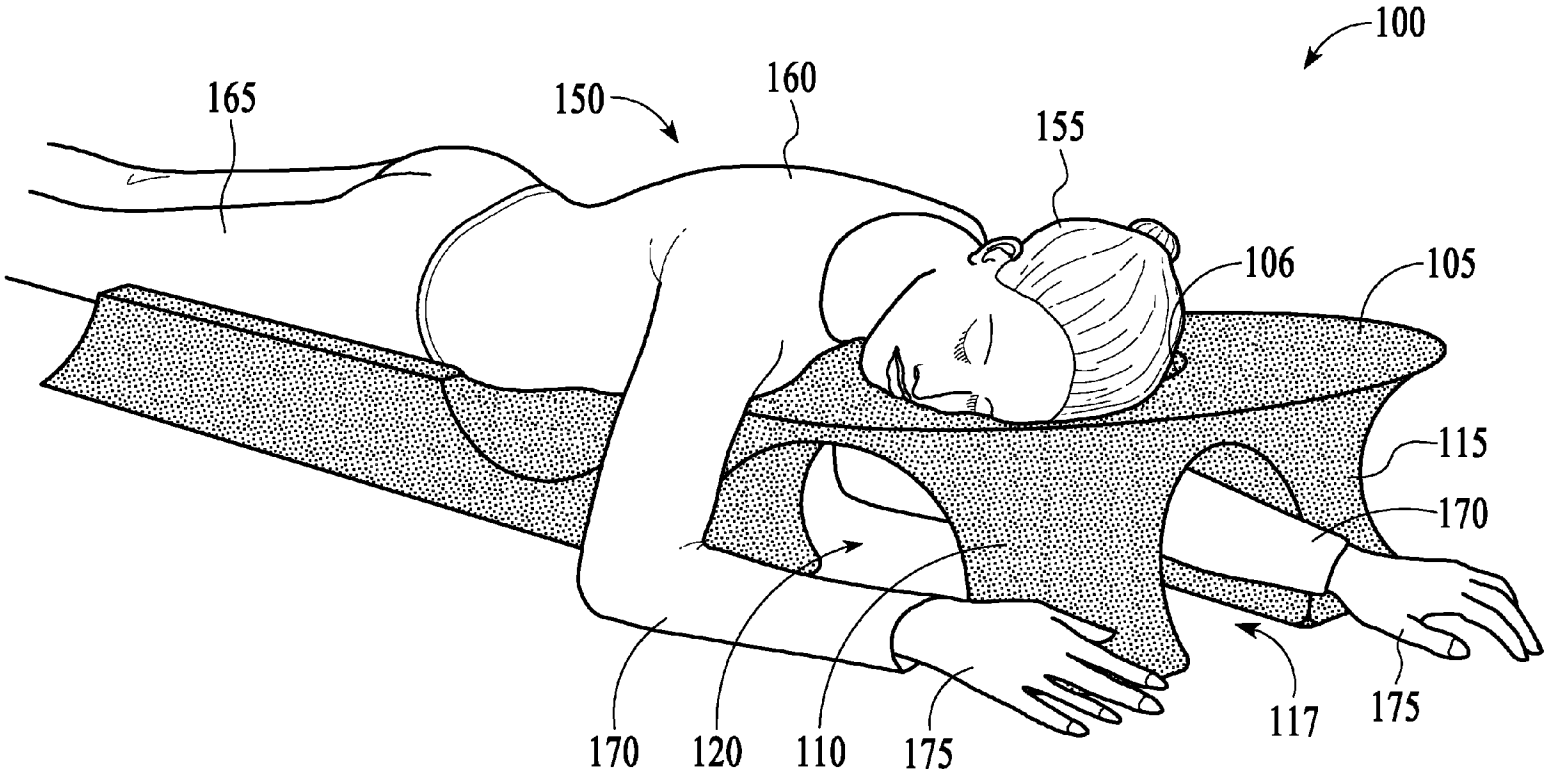
FIG. 11 is a third top perspective view of the embodiment of FIG. 1 showing the embodiment in use in a third configuration.

FIG. 11 is a third top perspective view of a first embodiment of the inventive pillow, structure, showing the embodiment in use in a third configuration. FIG. 11 illustrates a user using the opening in the head-side 117 to place her hand 175 or arm 170 out of the pillow structure 100. FIG. 11 shows one of the user's arms 170 extended through the hole at the top surface 106 with the user's face 155 turned sideways. The user's other arm 170 is outside the pillow structure 100 and lying to the side.

Figure 12:
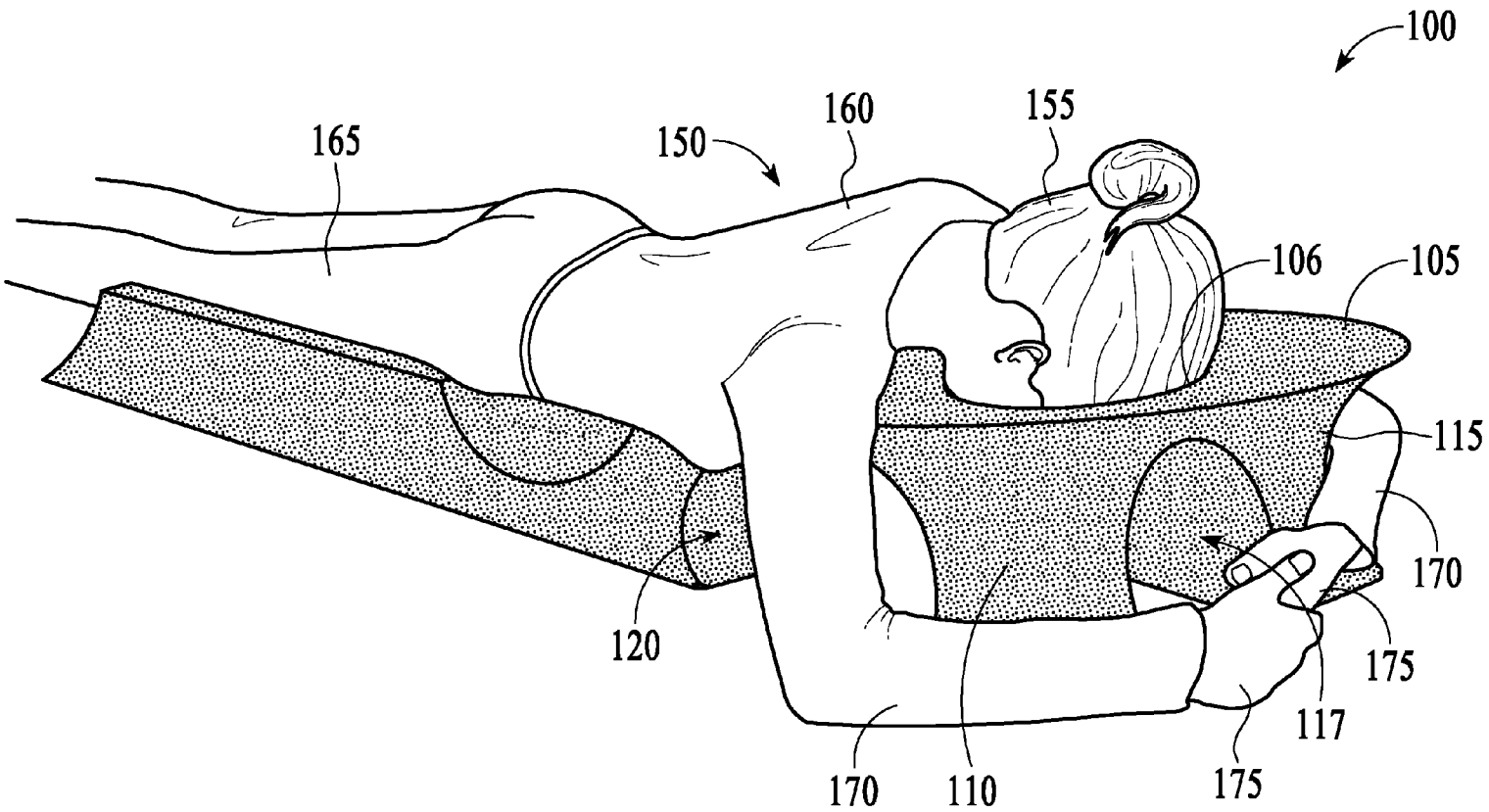
FIG. 12 is a fourth top perspective view of the embodiment of FIG. 1 showing the embodiment in use in a fourth configuration.

FIG. 12 is a fourth top perspective view of a first embodiment of the inventive pillow structure, showing the embodiment in use in a fourth configuration. FIG. 12 illustrates a user 150 with her arms 170 around the head-side 115 of the pillow structure 100.

Figure 13:
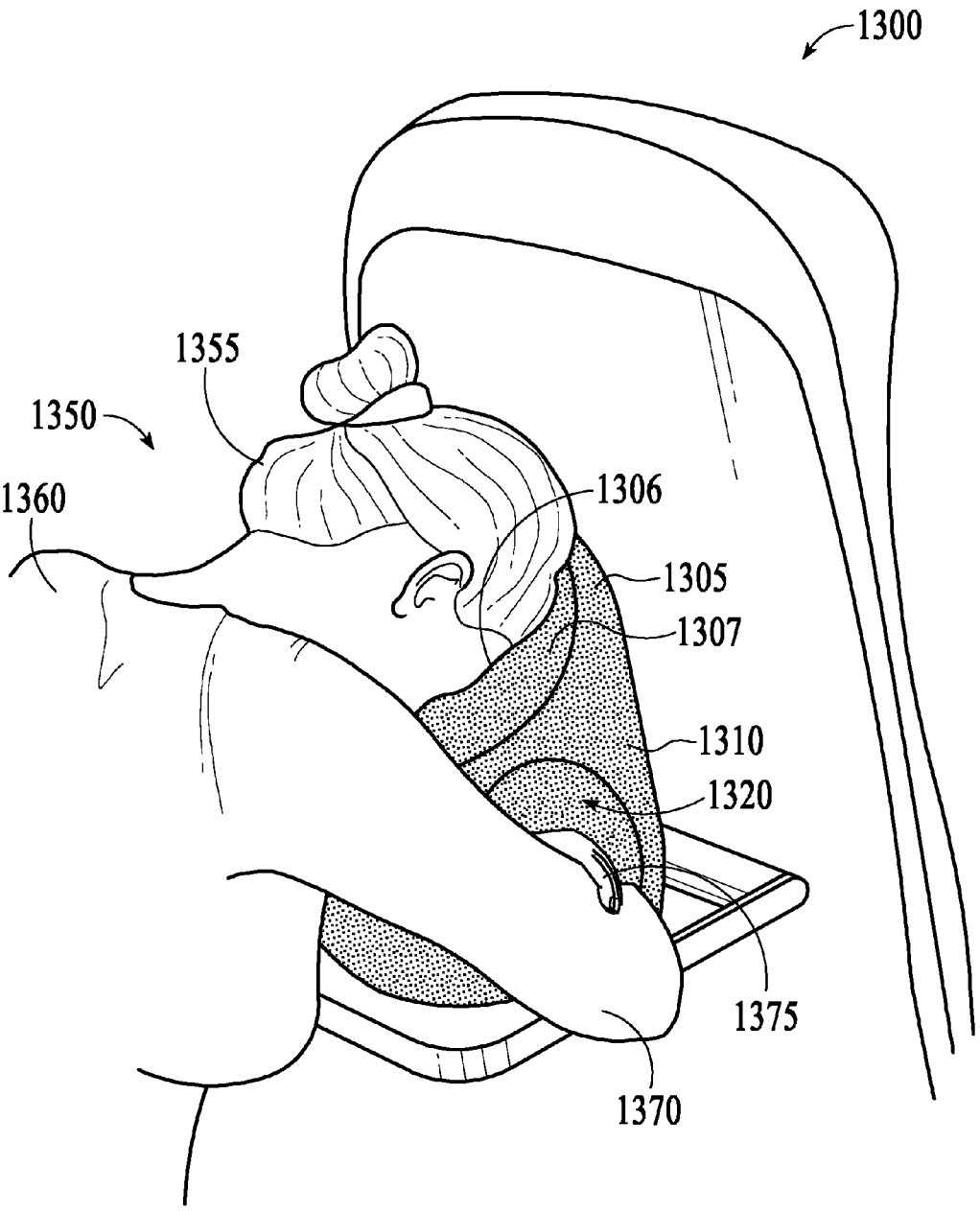
FIG. 13 is a top perspective view of a second embodiment of the inventive pillow structure, showing the embodiment in use.

A second embodiment of the inventive pillow structure is shown in FIG. 13. FIG. 13 is a top perspective view of a second embodiment of the inventive pillow structure, showing the embodiment in use. The pillow structure 1300 in the second embodiment is designed for a seated user 1350. This second embodiment of the pillow structure 1300 consists of a top surface 1305 and at least two sides 1310. In this embodiment, the sides 1310 are rounded without delineated edges and the overall shape of the pillow structure 1300 in this embodiment is cylindrical. The top surface of the pillow structure 1305 contains at least one opening 1306. The at least two sides 1310 contain at least two openings 1320 in the sides. A seated user can use this pillow structure when seated at a substantially flat object raised above the ground, such as a desk or table or other flat object, such as a tray-table on an airplane Like the pillow structure in the first embodiment, the pillow structure 1300 in the second embodiment is designed so that the user's face 1355 is at a comfortable elevation, higher than the individual's body 1360. By placing the user's face 1355 at a higher elevation than the user's body 1360, the user 1350 can place her arms 1370 and hands 1375 into the side openings 1320 in the side of the pillow structure 1310 and lean forward into the pillow structure, placing her face 1355 into the top opening 1306, without leaning too far at the waist or hips. When the user's arms 1370 are placed into the side openings 1320, the user's arms 1370 are in a comfortable position substantially perpendicular to the user's body 1360, which provides for comfortable access to object that may be placed in the cavity in the pillow structure. The pillow structure 1300 can be various heights and widths. The pillow structure 1300 can be placed at various distances from the user depending on the space available in front of the user and the height of the table or desk or supporting structure placed beneath the pillow structure. The embodiment in FIG. 13 shows the at least two side openings 1320 are large enough to provide adequate room for the user's arms 1370 and hands 1375 to be placed in the side openings 1320 and provide space for air to circulate through to the cavity. These side openings 1320 are also sized and shaped to provide room for cords or wires for electronic devices.

The top surface 1305 of the pillow structure in the second embodiment is angled at a slight and gradual incline for the comfort of the user leaning forward into the pillow structure.

The pillow structure 1300 in the second embodiment does not contain any openings in the head-side of the pillow structure.

Figure 14:
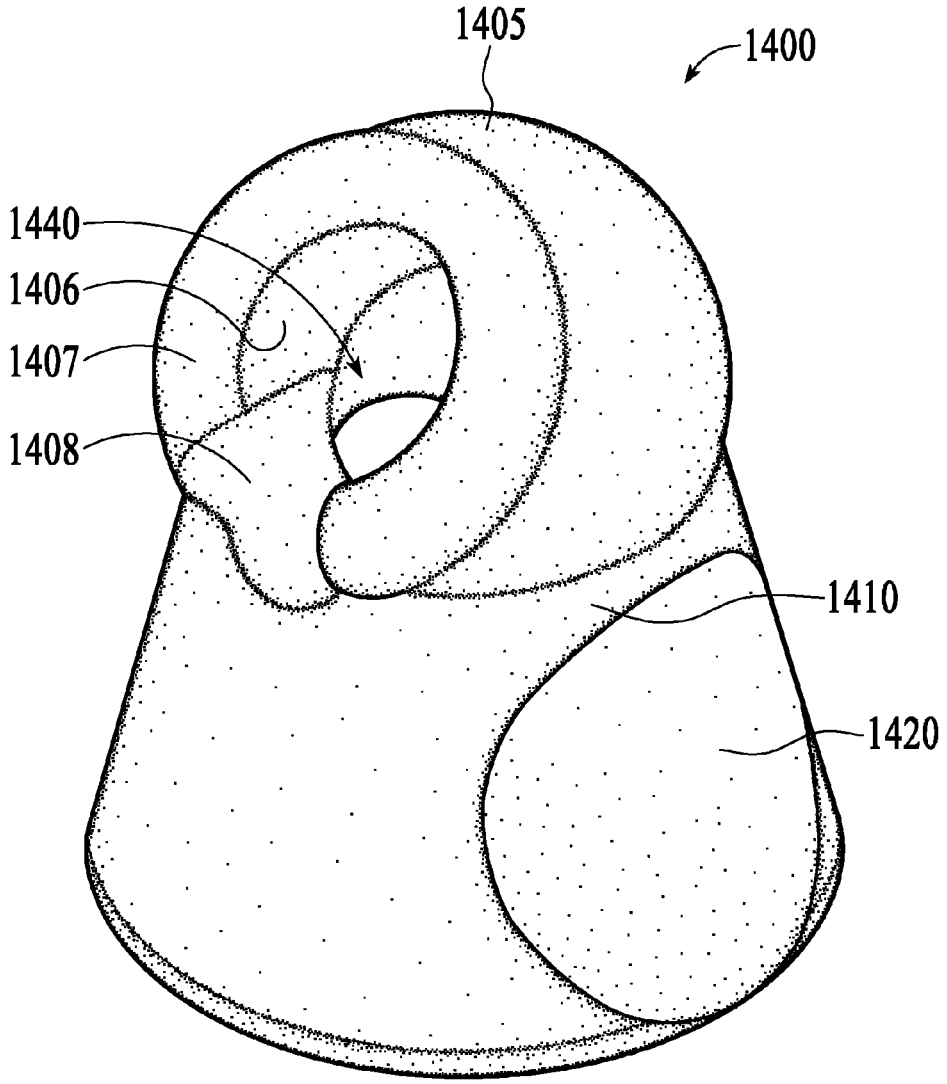
FIG. 14 is a top perspective view of the embodiment of FIG. 13, showing the embodiment without a user.

FIG. 14 is a top perspective view of a second embodiment of the inventive pillow structure of FIG. 13, showing the embodiment without a user. The top surface 1405 of the pillow structure 1400 is rounded with at least one opening 1406 in the top surface. The opening in the top surface 1406 in this embodiment is substantially at the top of the pillow structure 1400, but it is not necessarily at the apex of the pillow structure 1400. The opening at the top surface 1406 has a rim 1407 around the edge to support the user's face. The rim 1407 is rounded and is about an inch or two wide in this embodiment, but the rim 1407 can be any width or shape. The top opening 1406 in this embodiment is substantially circular-shaped, with a cut-out 1408 in the bottom portion. The cut-out 1408 and the inside edge 1411 of the cut-out 1408 provides additional support for the user's face or chin to rest when the users face is placed in the top opening 1406. The inside edge 1411 can be any shape, width, height, and diameter. In this embodiment, the inside edge of the top opening 1411 is substantially horizontal. The inside edge 1411 can be any angle. The cut-out 1408 also provides additional air circulation and flow near the user's mouth when the user's face is placed in the top opening 1406.

The pillow structure 1400 in this embodiment is substantially round and circular in shape. The at least two side openings 1420 in the sides provide access from the outside of the sides of the pillow structure to the cavity in the middle of the pillow structure 1440. The at least one opening in the top surface 1406 provides access to a cavity 1440. The cavity 1440 can be accessed from the outside of the pillow from the at least one opening on the top surface 1406 and from the at least two openings on the sides 1420. The at least two side openings 1420 provide space for the insertion of an object into the cavity 1440 in the middle of the pillow structure 1400, such as a mobile device, phone, tablet, gaming device, or other device. The side opening 1420 could also provide space for a power cord or wire for headphones. The cavity 1440 in the middle of the pillow structure can be various sizes and shapes to accommodate various objects or devices. The pillow structure 1400 may contain additional side openings or head-side openings for objects, cords, headphones, or wires to be inserted into the cavity 1440. The pillow structure 1400 may have additional side openings or head-side openings to provide space to illuminate the cavity 1440, or to increase air circulation or flow in the cavity 1440 or in the side openings 1420. This embodiment has an indented edge 1409 where the bottom of the rounded top surface 1405 meets the at least two sides 1410. The at least two sides 1410 are continuous, without delineations, since the pillow structure 1400 is circular with a circular base 1545. A different embodiment could have delineated sides 1410. The indented edge 1409 may not exist if the embodiment has a smooth transition where the top surface 1405 and the sides 1410 meet, such as the embodiment shown in FIG. 13.

Figure 15:
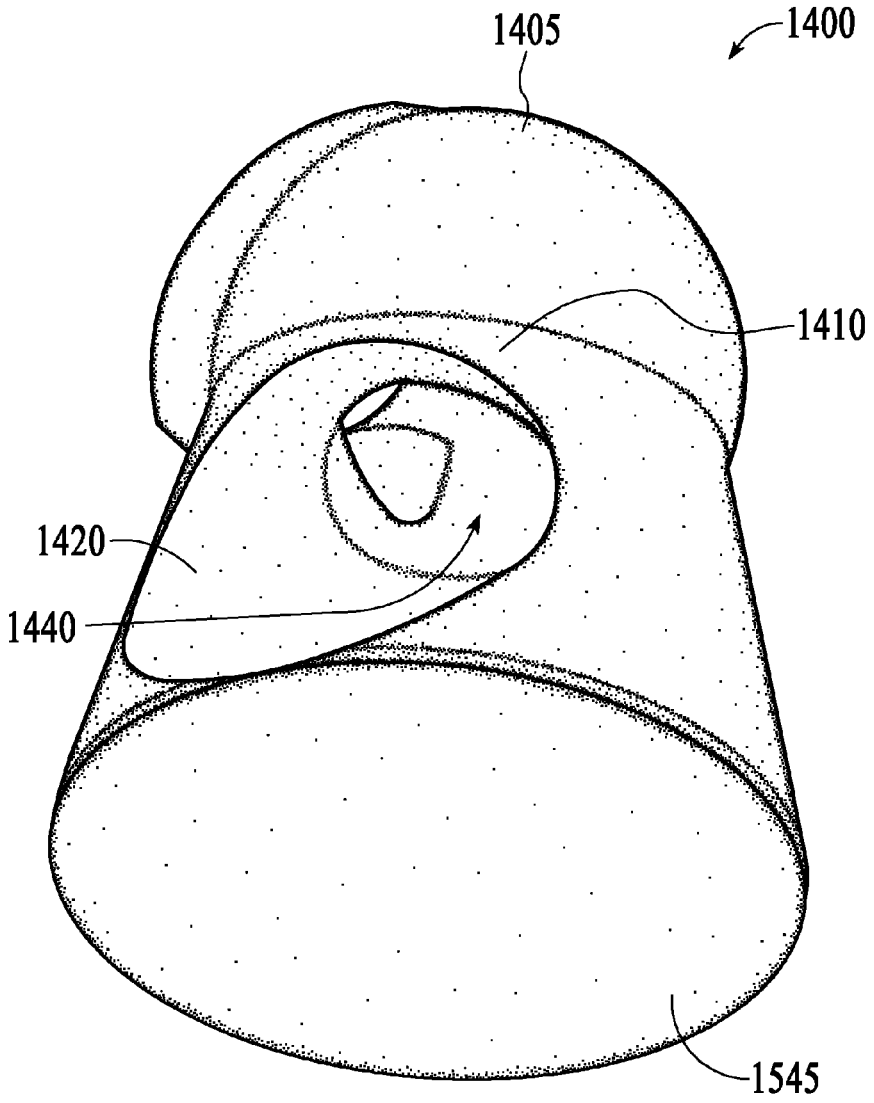
FIG. 15 is a bottom perspective view of the embodiment of FIG. 14.

FIG. 15 is a bottom perspective view of the embodiment of FIG. 14. The flat base 1545 of this embodiment is substantially circular, although the flat base 1545 can be various shapes. The flat base 1545 is wider at the base than the sides 1410 of the pillow structure 1400. The sides 1410 are tapered towards the top surface 1405 and flared outward to the base 1545 at the bottom of the pillow structure 1400. This wider flat base 1545 is not necessary for the invention, but it increases the balance of the pillow structure 1400, so that the pillow structure does not tip over.

Figure 16:
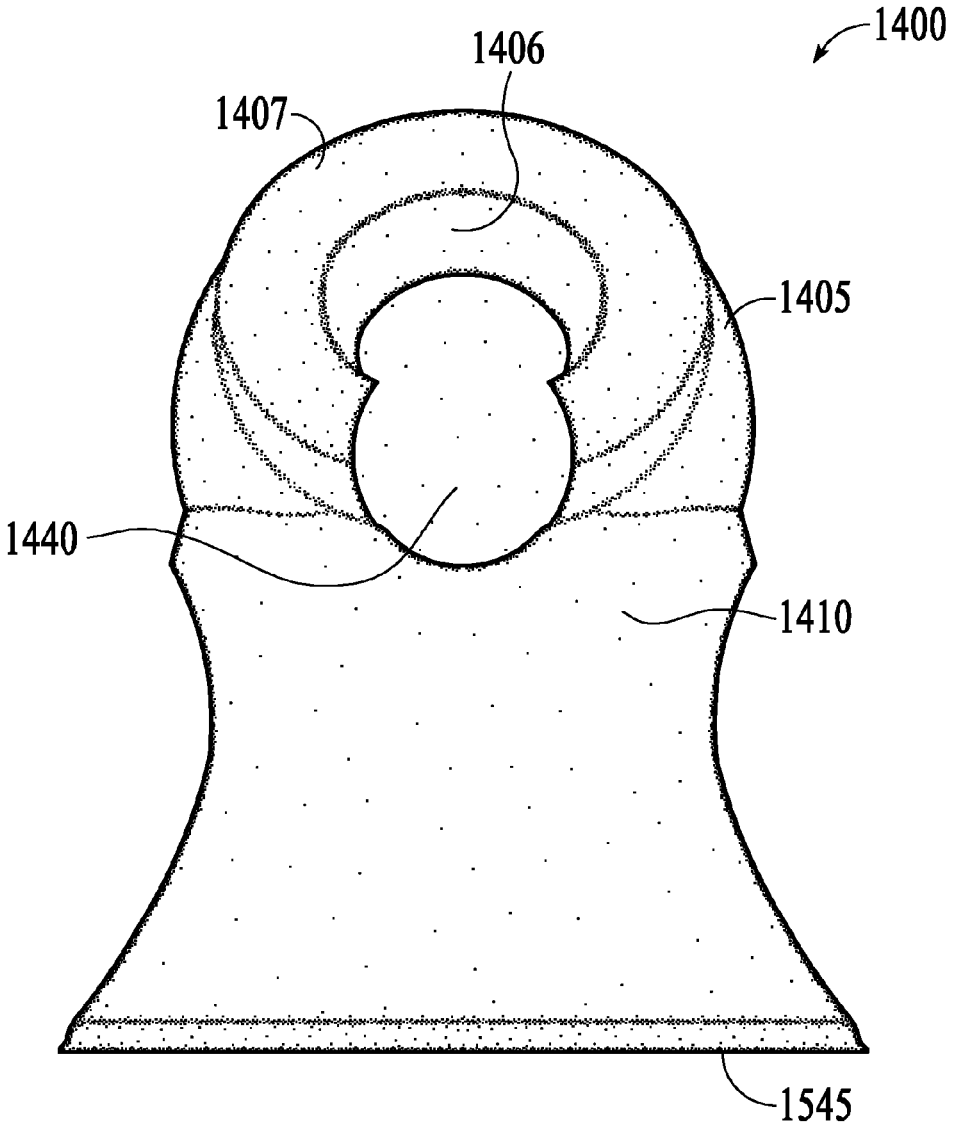
FIG. 16 is a front view of the embodiment of FIG. 14.

FIG. 16 is a front view of the embodiment of FIG. 14. FIG. 16 shows the concave shape of the sides 1410 with the side openings 1420 from the front view. The cut-out 1408 at the lower end of the top opening 1406 is shown here to be substantially round, although it can be any shape, width, and depth. The rim 1407 is substantially round and extends both up and out from the top surface 1405 of the pillow structure, but the rim 1407 can be any shape, width, and depth. The rim 1407 does not need to protrude or extend either up or out from the top surface 1405.

Figure 17:
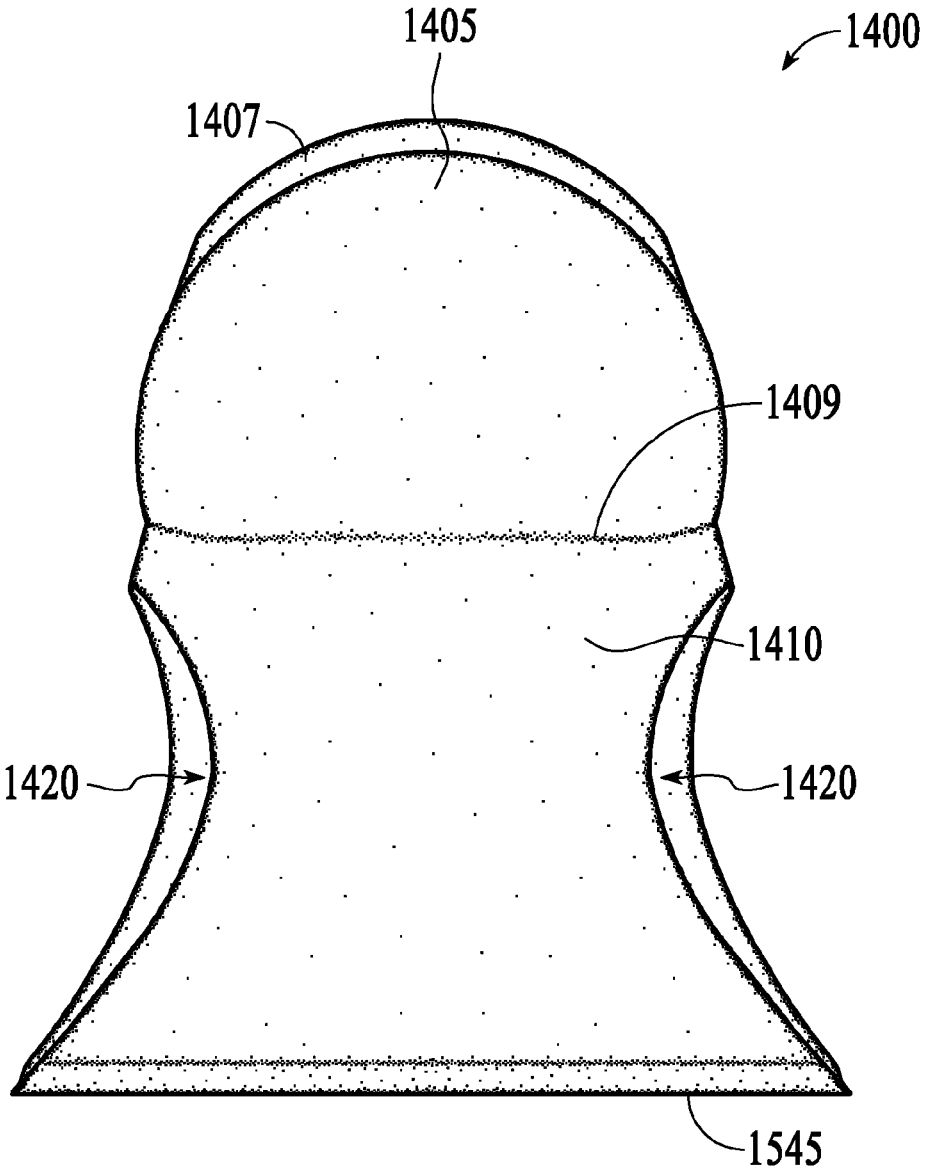
FIG. 17 is a head-side view of the embodiment of FIG. 14.

FIG. 17 is a head-side view of the embodiment of FIG. 14. The openings in the sides 1420 are on substantially opposite locations of the pillow structure 1400. FIG. 14 shows the rim 1407 protruding upward toward the front of the pillow structure 1400. The top surface 1405 is substantially rounded and circular with an indented edge 1409 where the bottom of the rounded top surface 1405 meets the at least one sides 1410.

Figure 18:
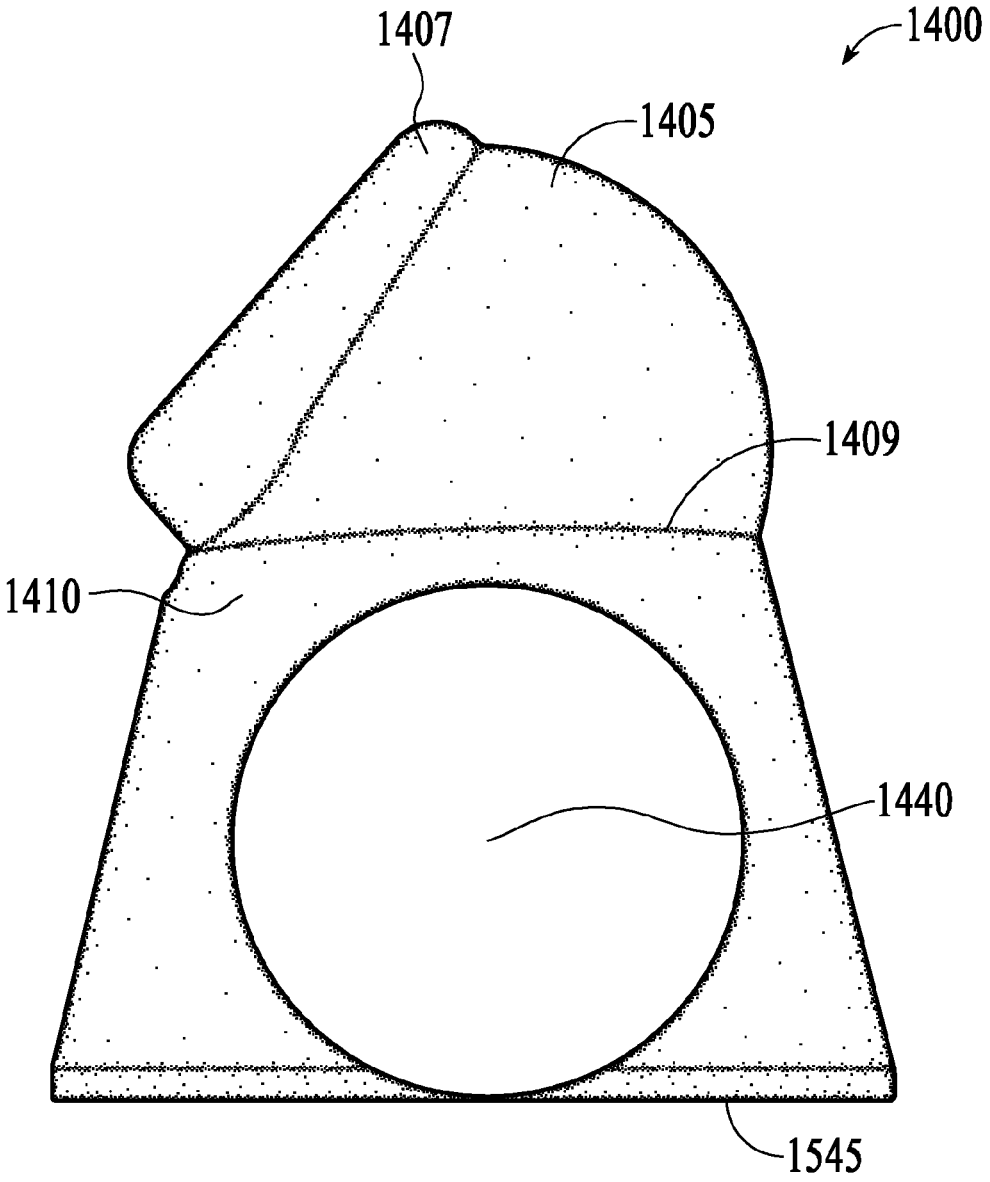
FIG. 18 is a right side view of the embodiment of FIG. 14.

FIG. 18 is a right side view of the embodiment of FIG. 14. FIG. 18 further demonstrates that the side openings 1420 are on substantially opposite sides of the pillow structure 1400, as the angle shows that objects can pass straight through one side opening 1420 through the cavity 1440 and through the other side opening 1420. These side openings 1420 are circular in shape, but they can be any shape and size that allows a user's arms 1470 and hand 1475 to be inserted into the side opening 1420. The side openings 1420 do not extend through the flat base 1545 in this embodiment.

Figure 19:
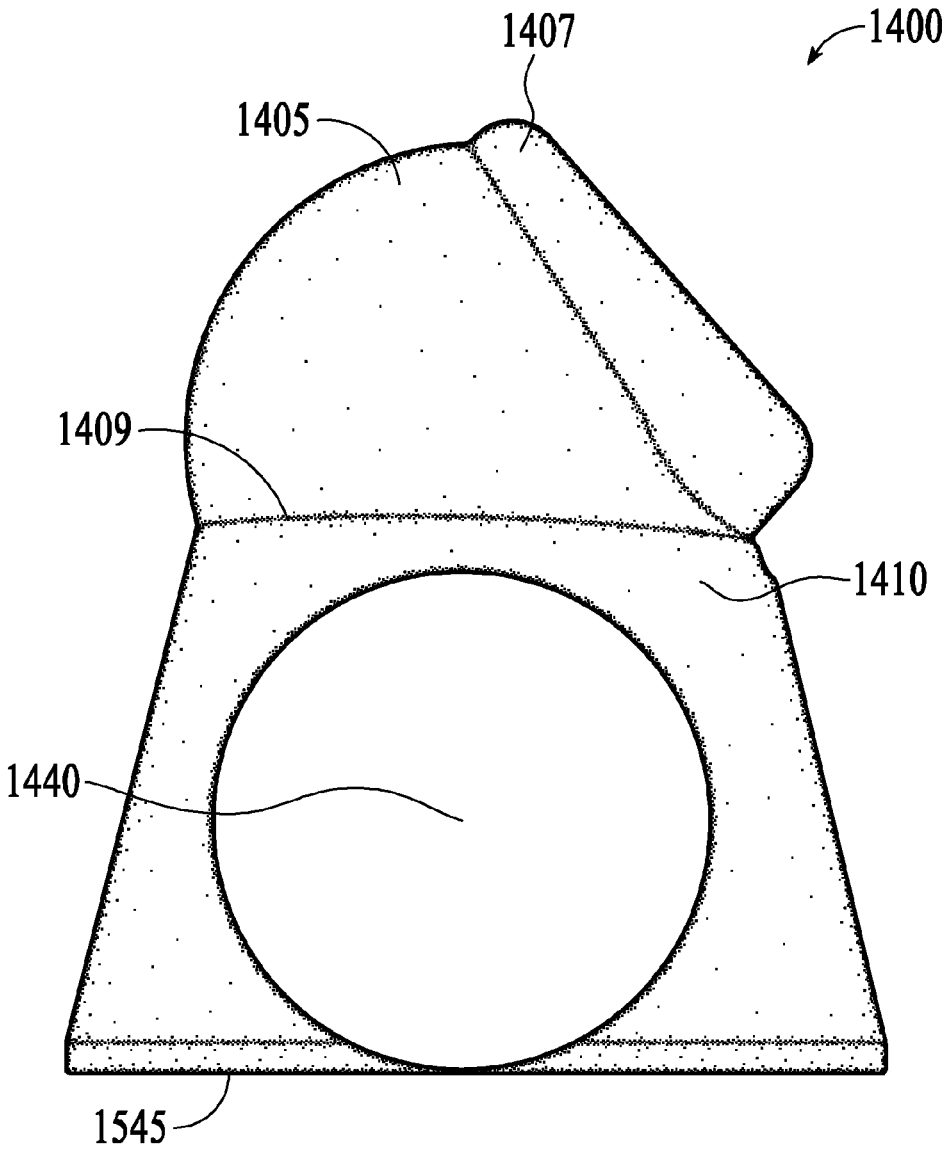
FIG. 19 is a left side view of the embodiment of FIG. 14.

FIG. 19 is a left side view of the embodiment of FIG. 14. FIG. 14 further demonstrates that the side openings 1420 are on substantially opposite sides of the pillow structure 1400. This view shows the pillow structure 1400 from the opposite view from FIG. 18.

Figure 20:
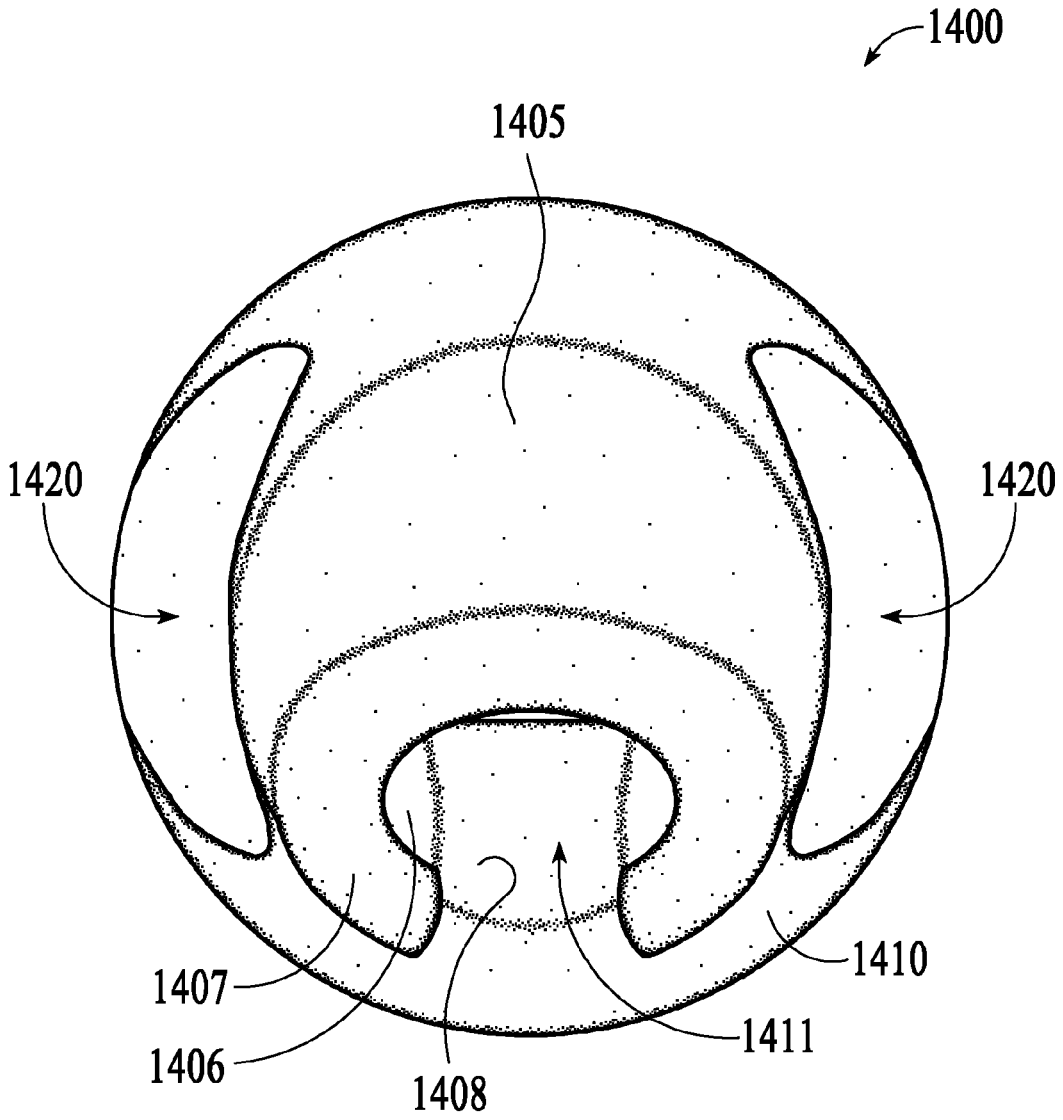
FIG. 20 is a top view of the embodiment of FIG. 14.

FIG. 20 is a top view of the embodiment of FIG. 14. FIG. 20 further demonstrates that the base 1545 of the pillow structure 1400 is wider than the top surface 1405 of the pillow structure in this embodiment. This angle also shows the inside edge 1411 of the cut-out 1408 in the top opening 1406.

Figure 21:
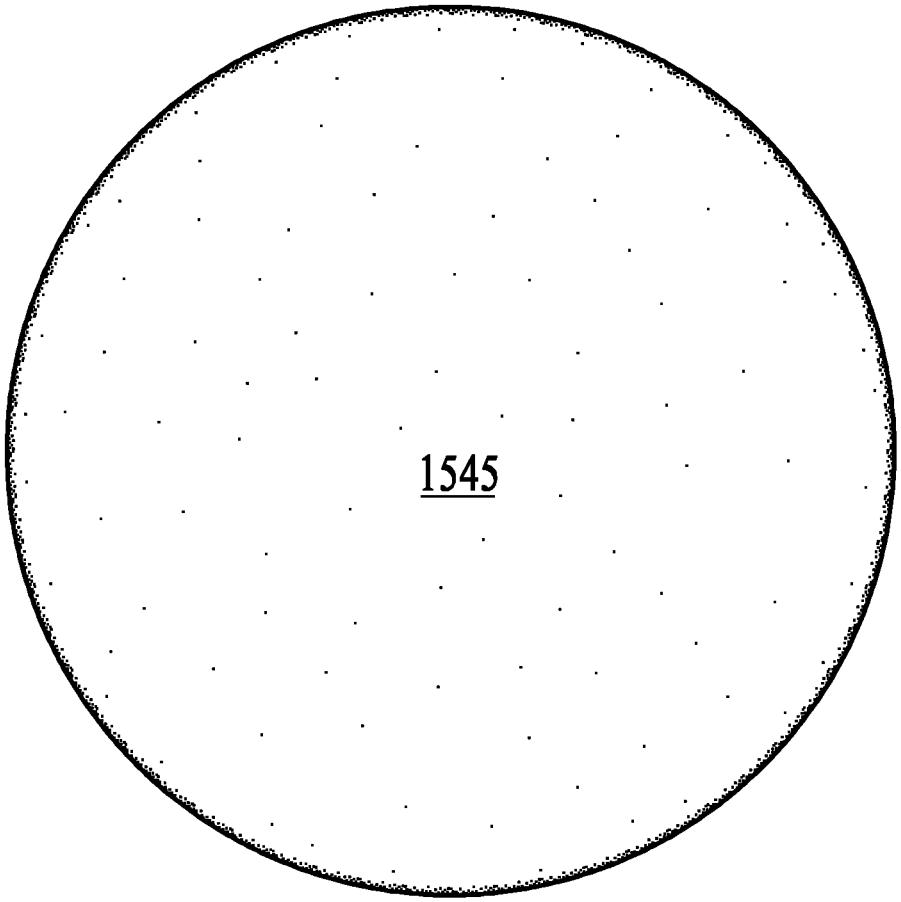
FIG. 21 is a bottom view of the embodiment of FIG. 14.

FIG. 21 is a bottom view of the embodiment of FIG. 14. FIG. 21 further demonstrates the overall circular shape of the base 1545 of the pillow structure 1400. The side openings 1420 do not extend through the flat base 1545 in this embodiment in contrast to the first embodiment.

It is not expected that the invention be restricted to the exact embodiments disclosed herein. Modifications can be made without departing from the inventive concept. For example, other materials can be used to manufacture the pillow structure other than those listed. The scope of the invention should be construed in view of the claims.

The invention claimed is:

1. A pillow structure including:

a top surface, at least two sides, a substantially flat bottom surface, and at least three openings, including;

at least one top opening through the top surface of said pillow structure, said top opening configured such that a user's face can be supported against edges of said top opening when said user is positioned face down on said pillow structure, at least two side openings extending from an outer edge of the at least two sides of said pillow structure, said at least two side openings configured to insert said user's arms there through when said user is positioned face down on said pillow structure;

said at least two side openings being dimensioned to insert the user's arms therein and prevent pressure on said user's arms caused by weight of said user's body when said user is supported on said pillow structure and said user's arms are inserted into said side openings, while leaving sufficient space for air flow; and a cavity in an internal region of said pillow structure, wherein said cavity can be accessed from said at least one top opening and said at least two side openings;

wherein said top surface is contoured to support the body;

wherein a portion of said top surface is also contoured along at least one edge where said top surface meets said at least two sides;

wherein said bottom surface has a width that is wider than a width of said top surface, wherein said pillow structure extends less than the length of the user's body, and ends at or above said user's knees; and wherein said pillow structure is wedge shaped such that said user's face is at a slightly higher elevation than said user's body and legs.

2. The pillow structure of claim 1 wherein said at least one top opening is substantially circular.

3. The pillow structure of claim 1, wherein said user is able to view and/or interact with a device or book placed inside said cavity.

4. The pillow structure of claim 1, wherein the at least two side openings enable access to audio from the outside of the pillow structure to the cavity.

5. The pillow structure of claim 1, with at least one additional opening in the pillow structure in addition to the two side openings in the sides of the pillow structure.

6. The pillow structure of claim 5 wherein said at least one additional opening provides additional air circulation from the outside of the pillow structure to the cavity.

7. The pillow structure of claim 5 wherein the at least one additional opening enables access to light from a light source from the outside of the pillow structure to the cavity.

8. The pillow structure of claim 5 wherein the at least one additional opening enable access to power from a power source from the outside of the pillow structure to the cavity.

9. The pillow structure of claim 5, where there is a head-side to the pillow structure, and wherein the at least one additional opening is an opening in the head-side of the pillow structure.

10. The pillow structure of claim 1 wherein the at least two side openings are on substantially opposite sides of the pillow structure so that in use, the user's arms, when inserted into the at least two side openings, are beneath the user's face and substantially perpendicular to the user's body.

11. The pillow structure of claim 10 wherein said at least two side openings are sized so that there is an additional space around the user's arm.

12. The pillow structure of claim 11 wherein the additional space around the user's arms enables air flow from the outside of the pillow structure to the cavity.

13. The pillow structure of claim 11 wherein the additional space around the user's arms enables access to light from a light source from the outside of the pillow structure to the cavity.

14. The pillow structure of claim 11 wherein the additional space around the user's arms enables access to power from a power source from the outside of the pillow structure to the cavity.

* * * * *